US009627167B2

(12) United States Patent
Yu et al.

(10) Patent No.: US 9,627,167 B2
(45) Date of Patent: Apr. 18, 2017

(54) APPARATUS FOR GENERATING PLASMA

(71) Applicant: Electronics and Telecommunications Research Institute, Daejeon (KR)

(72) Inventors: Han Young Yu, Daejeon (KR); Yark Yeon Kim, Daejeon (KR); Won Ick Jang, Daejeon (KR); Yong Sun Yoon, Daejeon (KR); Bong Kuk Lee, Daejeon (KR)

(73) Assignee: ELECTRONICS AND TELECOMMUNICATIONS RESEARCH INSTITUTE, Daejeon (KR)

( * ) Notice: Subject to any disclaimer, the term of this patent is extended or adjusted under 35 U.S.C. 154(b) by 0 days.

(21) Appl. No.: 14/631,766

(22) Filed: Feb. 25, 2015

(65) Prior Publication Data

US 2015/0245458 A1 Aug. 27, 2015

(30) Foreign Application Priority Data

Feb. 25, 2014 (KR) ..... 10-2014-0021920
Apr. 3, 2014 (KR) ..... 10-2014-0040190
(Continued)

(51) Int. Cl.
*H01J 7/24* (2006.01)
*H01J 7/42* (2006.01)
(Continued)

(52) U.S. Cl.
CPC *H01J 7/42* (2013.01); *H01J 7/24* (2013.01); *H05H 1/34* (2013.01); *H05H 1/36* (2013.01); *H05H 1/48* (2013.01)

(58) Field of Classification Search
CPC ..... H01J 7/24; H01J 7/42; H05H 1/36; H05H 1/48; H05H 1/34
(Continued)

(56) References Cited

U.S. PATENT DOCUMENTS 8,574,445 B2 11/2013 Cho et al.
9,067,273 B1 * 6/2015 Kim ..... H05H 1/2406
(Continued)

FOREIGN PATENT DOCUMENTS

KR 10-0943431 B1 2/2010
KR 10-1046335 B1 7/2011
(Continued)

OTHER PUBLICATIONS

Cao, Z. et al., "Atmospheric Plasma Jet Array in Parallel Electric and Gas Flow Fields for Three-Dimensional Surface Treatment," Applied Physics Letters, 2009, 94 (2), article 021501, pp. 1-3.

*Primary Examiner* — Tung X Le

(57) ABSTRACT

Provided herein an apparatus for generating plasma, the apparatus including a nozzle array, first electrode, and housing. The nozzle discharges plasma. The first electrode is disposed to surround the nozzle array. The housing is disposed to surround the nozzle array and first electrode. The nozzle includes a plurality of nozzles disposed adjacent to one another and in the form of an array, each nozzle configured to discharge plasma. Therefore, it is possible to generate a large size plasma evenly and stably.

18 Claims, 9 Drawing Sheets

(30) Foreign Application Priority Data

Aug. 12, 2014 (KR) ..... 10-2014-0104364
Feb. 16, 2015 (KR) ..... 10-2015-0023301

(51) Int. Cl.
*H05H 1/36* (2006.01)
*H05H 1/48* (2006.01)
*H05H 1/34* (2006.01)

(58) Field of Classification Search
USPC ..... 315/111.21
See application file for complete search history.

(56) References Cited

U.S. PATENT DOCUMENTS

| | | | | |
|---|---|---|---|---|
| 2003/0129107 | A1 | 7/2003 | Denes et al. | |
| 2007/0176562 | A1* | 8/2007 | Takikawa | H05H 1/48 315/111.21 |
| 2008/0073202 | A1 | 3/2008 | Lee et al. | |
| 2009/0102385 | A1* | 4/2009 | Wi | H01J 37/32091 315/111.21 |
| 2011/0132543 | A1* | 6/2011 | Yu | H05H 1/2406 156/345.35 |
| 2013/0153545 | A1 | 6/2013 | Kim et al. | |
| 2013/0158466 | A1 | 6/2013 | Kim et al. | |
| 2015/0030786 | A1* | 1/2015 | Coe | C23C 16/274 427/575 |

FOREIGN PATENT DOCUMENTS

| | | | |
|---|---|---|---|
| KR | 10-2013-0069064 | A | 6/2013 |
| KR | 10-2013-0069082 | A | 6/2013 |

* cited by examiner

APPARATUS FOR GENERATING PLASMA

CROSS-REFERENCE TO RELATED APPLICATION

The present application claims priority to Korean Patent Application No. 10-2014-0021920 filed on Feb. 25, 2014, Korean Patent Application No. 10-2014-0040190 filed on Apr. 3, 2014, Korean Patent Application No. 10-2014-0104364 filed on Aug. 12, 2014 and Korean Patent Application No. 10-2015-0023301 filed on Feb. 16, 2015, the entire disclosure of which is incorporated herein in their entirety by reference.

BACKGROUND

Field of Invention

Various embodiments of the present disclosure relate to plasma, and more particularly, to an apparatus for generating plasma.

Description of Related Art

In general plasma technology, a plurality of singular type plasma needles form an array. Such an array type plasma is classified as an array plasma jet, but since this creates empty spaces between the individual plasma needles where plasma cannot be generated, it is difficult to generate plasma evenly in large sizes with such an array type plasma.

So far, efforts have been made to embody hall-type plasma generators having large cross section areas in order to increase the area of plasma being generated. However, this type of plasma generators is disadvantageous in that they consume large amounts of gas in generating plasma while it is also difficult to generate plasma in large sizes.

Thus, embodying stable plasma of large sizes to use to reform a subject surface such as skin requires the area of plasma generated to be large, plasma generation to be stable, and gas consumption for plasma generation to be small.

Furthermore, in general plasma technology, plasma is emitted directly to a medium through a plasma nozzle. The purpose of such technology is to maximize the effect of the plasma being emitted to the medium by configuring the plasma to have a high density. However, in such technology, in order to change the constituents of a fluid, the plasma nozzle must be exposed, thereby generating vortexes which may take up most of the plasma. Not only that, one cannot exclude the possibility that when plasma is emitted directly to the medium, the pressure of the fluid may increase, causing the plasma to backflow. That is, there is a possibility that the fluid of high pressure may affect the plasma nozzle, causing the plasma to backflow, and thus changing the plasma nozzle physically and chemically.

Furthermore, a general plasma generating apparatus has a nozzle so that the plasma may be sprayed to a surface or a medium having a space, thereby changing the constituents thereof. However, in such a plasma apparatus where fluid flows by way of such a plasma nozzle, there needs to be a technology for the plasma to change the constituents of the fluid.

SUMMARY

An embodiment of the present disclosure is directed to an apparatus for generating plasma capable of generating plasma evenly and stably.

Another embodiment of the present disclosure is directed to an apparatus for generating plasma including a plasma spray nozzle capable of being introduced into a fluid and reforming the fluid.

Another embodiment of the present disclosure is directed to an apparatus for generating plasma capable of emitting plasma evenly to a flowing fluid.

According to an embodiment of the present disclosure, there is provided an apparatus for generating plasma, the apparatus including a nozzle array configured to discharge plasma; a first electrode disposed to surround the nozzle array; and a housing disposed to surround the nozzle array and first electrode, wherein the nozzle array includes a plurality of nozzles disposed adjacent to one another in the form of an array, each nozzle configured to discharge plasma.

In the embodiment, at least a portion of each of the plurality of nozzles included in the nozzle array may be made of a conductive material.

In the embodiment, the each of the plurality of nozzles may be disposed to contact its adjacent nozzles through the portion made of the conductive material.

In the embodiment, the housing may include a plasma outlet through which the plasma discharged from the nozzle array is sprayed.

In the embodiment, the housing may be disposed with a certain distance from the nozzle array and first electrode, and form a protection gas path.

In the embodiment, the housing may include a side outlet configured to discharge the plasma already sprayed to a surface.

In the embodiment, the first electrode may contact at least a portion of the plurality of nozzles of the nozzle array.

In the embodiment, the apparatus may further include a second electrode configured to have a shape of a ring, on the housing.

In the embodiment, the second electrode may be grounded.

In the embodiment, the second electrode may generate a high voltage, and the first electrode may be grounded or floated.

In the embodiment, a cross-section of an exterior and interior of each of the plurality of nozzles may be both circular.

In the embodiment, a cross-section of an exterior and interior of each of the plurality of nozzles may be both polygonal.

In the embodiment, a cross-section of an exterior of each of the plurality of nozzles may be polygonal and a cross-section of an interior of each of the plurality of nozzles may be circular.

According to an embodiment of the present disclosure, there is provided an apparatus for generating plasma, the apparatus including a plasma generating unit configured to generate plasma; and a plasma outlet configured to outlet the generated plasma, wherein the plasma outlet disperses the plasma generated by the plasma generating unit in a plurality of plasma flows.

In the embodiment, the plasma outlet may include a plasma moving unit through which the plasma generated by the plasma generating unit moves; and a plasma nozzle disposed inside the plasma moving unit, includes a plurality of spray nozzles, and disperses the plasma generated by the plasma generating unit in the plurality of plasma flows.

In the embodiment, the plasma moving unit may have a shape of a pipe, and the plurality of spray nozzles formed in the plasma nozzle may be arranged evenly in an array format.

According to an embodiment of the present disclosure, there is provided an apparatus for generating plasma, the apparatus including a fluid inflow unit configured to generate fluid; a fluid moving path configured to move the generated fluid; and at least one plasma curtain disposed inside or outside the fluid moving path, and configured to spray the plasma to the fluid.

In the embodiment, the plasma curtain may include a plasma moving path formed to have a lattice shape; and a plurality of plasma spray nozzles formed in a vertical, horizontal or in a certain angle with respect to a moving direction of the fluid on the lattice shaped plasma moving path.

In the embodiment, the plasma curtain may include a plurality of plasma moving paths arranged parallel to one another, and on the plurality of moving paths arranged parallel to one another, a plurality of plasma spray nozzles may be formed in a direction vertical to a moving direction of the fluid.

In the embodiment, the at least one plasma curtain may include a first plasma curtain and second plasma curtain, the first plasma curtain including a plurality of first plasma moving paths arranged parallel to one another in a first direction, the second plasma curtain including a plurality of second plasma moving paths arranged parallel to one another in a second direction that is vertical to the first direction, and the first direction and second direction both in a vertical, horizontal, or a certain angle with respect to a moving direction of the fluid, on the first plasma moving paths arranged parallel to one another, a plurality of first plasma spray nozzles may be each formed in a direction vertical to a moving direction of the fluid, and on the second plasma moving paths arranged parallel to one another, a plurality of second plasma spray nozzles may be each formed in a vertical, horizontal, or certain angle with respect to the moving direction of the fluid, and the plasma curtain may be configured such that the fluid passes between the second plasma moving paths after passing between the first plasma moving paths successively.

An apparatus for generating plasma according to an embodiment of the present disclosure is capable of generating plasma stably. Furthermore, the apparatus is capable of generating a large size plasma.

An apparatus for generating plasma according to another embodiment of the present disclosure is capable of preventing plasma from back flowing by a pressure of a fluid when the plasma is generated. Furthermore, it is capable of preventing a nozzle being changed by a compound of the plasma and fluid back flowing by the fluid when the plasma is generated.

An apparatus for generating plasma according to another embodiment of the present disclosure includes a plasma curtain configured to spray plasma in a vertical, horizontal, or in a certain angle with respect to a flow of a fluid, and is thus capable of evenly reforming the fluid flowing with a certain pressure. Furthermore, the plasma curtain of the present disclosure is capable of continuously reforming the flowing fluid.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1A:
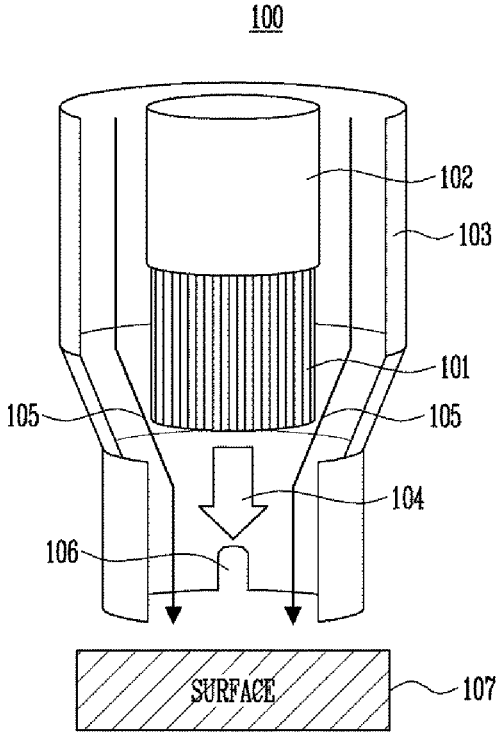
FIGS. 1*a* and 1*b* are views illustrating an apparatus for generating plasma according to an embodiment of the present disclosure.

Hereinafter, embodiments will be described in greater detail with reference to the accompanying drawings. Embodiments are described herein with reference to cross-sectional illustrations that are schematic illustrations of embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but may include deviations in shapes that result, for example, from manufacturing. In the drawings, lengths and sizes of layers and regions may be exaggerated for clarity. Like reference numerals in the drawings denote like elements.

Terms such as 'first' and 'second' may be used to describe various components, but they should not limit the various components. Those terms are only used for the purpose of differentiating a component from other components. For example, a first component may be referred to as a second component, and a second component may be referred to as a first component and so forth without departing from the spirit and scope of the present disclosure. Furthermore, 'and/or' may include any one of or a combination of the components mentioned.

Furthermore, a singular form may include a plural from as long as it is not specifically mentioned in a sentence. Furthermore, "include/comprise" or "including/comprising" used in the specification represents that one or more components, steps, operations, and elements exist or are added.

Furthermore, unless defined otherwise, all the terms used in this specification including technical and scientific terms have the same meanings as would be generally understood by those skilled in the related art. The terms defined in generally used dictionaries should be construed as having the same meanings as would be construed in the context of the related art, and unless clearly defined otherwise in this specification, should not be construed as having idealistic or overly formal meanings.

It is also noted that in this specification, "connected/coupled" refers to one component not only directly coupling another component but also indirectly coupling another component through an intermediate component. On the other hand, "directly connected/directly coupled" refers to one component directly coupling another component without an intermediate component.

Figure 1B:
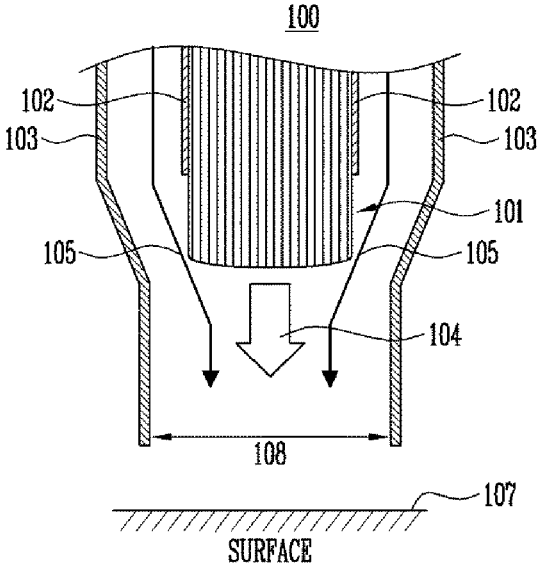

FIGS. 1*a* and 1*b* are views illustrating an apparatus for generating plasma according to an embodiment of the present disclosure.

FIG. 1*a* is a partial cross-sectional view of an apparatus for generating plasma according to an embodiment of the present disclosure 100. FIG. 1*b* is a cross-sectional view of the apparatus for generating plasma according to the embodiment of the present disclosure 100.

Referring to FIGS. 1*a* and 1*b*, the apparatus for generating plasma according to the embodiment of the present disclosure 100 includes a nozzle array 101, first electrode 102 and housing 103. The nozzle array 101 discharges plasma 104. The first electrode 102 is disposed to surround the nozzle array 101. The housing 103 is disposed to surround the nozzle array 101 and first electrode 102. The nozzle array 101 includes a plurality of nozzles disposed adjacent to one another in the form of an array, each nozzle configured to discharge the plasma.

The plurality of nozzles included in the nozzle array 101 may each have the shape of a needle. Each nozzle for generating plasma may be made of an electrode having conductivity. Otherwise, in another embodiment, each nozzle may be made of a nonconductor or insulator material having a structure where a conductive material is attached to at least a portion thereof That is, at least of portion of each of the plurality of nozzles included in the nozzle array 101 may be made of a conductive material. Therefore, the plurality of nozzles included in the nozzle array 101 may be disposed such that they each contact adjacent nozzles through the aforementioned portion made of the conductive material.

Each of the nozzles included in the nozzle array 101 for generating plasma may be configured as a cylinder in the shape of a needle. Preferably, the nozzles may be disposed adjacent to one another such that they minimize empty space there between and form the nozzle array 101. If empty space is formed between nozzles, plasma may be formed between the nozzles, and thus plasma may not be formed evenly. Plasma gas will be supplied into the cylinder type nozzle included in the nozzle array 101, and plasma will be formed at the ends of the nozzles, thereby forming plasma evenly and stably. In the apparatus for generating plasma according to the present disclosure, the plurality of nozzles are formed in the shape of needles disposed adjacent to one another such that they minimize empty space between them, thereby forming a large size plasma evenly and stably.

The housing 103 of the apparatus for generating plasma 100 may be disposed to surround the nozzle array 101 and first electrode 102. The housing 103 may include a plasma outlet 108 configured to discharge the plasma 104 generated in the nozzle array 101. The plasma 104 generated in the nozzle array 101 may be sprayed through the plasma outlet 106 to touch a surface 107.

The housing 103 may be distanced with a certain distance from the nozzle array 101 and first electrode 102, and form a protection gas path. Protection gas 105 may be generated from a protection gas generator (not illustrated) and be guided to flow through the protection gas path. The protection gas 105 may play a role of minimizing contact with gas from outside so that plasma may be generated evenly.

The housing 103 may include a side outlet 106 configured to discharge the plasma 104 already been sprayed to the surface 107. When generating the plasma 104 with the apparatus for generating plasma 100 disposed closely to the surface 107, in some cases, the plasma that has touched the surface 107 may remain in the housing 103 without being discharged outside smoothly. In such a case, the plasma that failed to escape outside and remains inside the housing 103 may interrupt the flow of plasma 104 being newly generated. The apparatus for generating plasma according to the embodiment of the present disclosure 100 includes the side outlet 106 in the housing 103 so that the side outlet 106 may guide the plasma 104 to quickly escape outside after touching the surface 107.

Figure 2A:
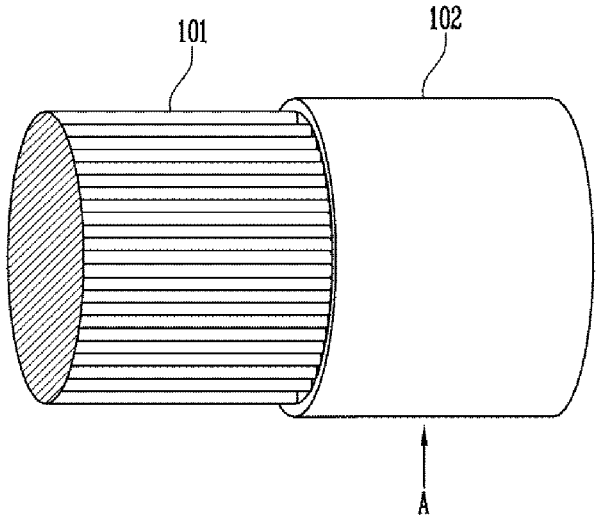
FIGS. 2*a* and 2*b* are views illustrating in detail a nozzle array and first electrode of an apparatus for generating plasma according to an embodiment of the present disclosure.
Figure 2B:
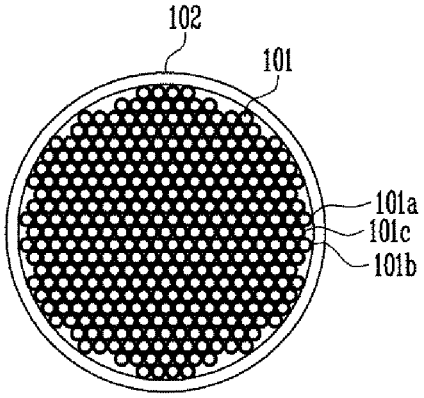

FIGS. 2*a* and 2*b* are views illustrating in detail a nozzle array and first electrode of an apparatus for generating plasma according to an embodiment of the present disclosure.

FIG. 2*a* illustrates the nozzle array 101 and first electrode 102 according to the embodiment of the present disclosure seen from a side. FIG. 2*b* illustrates a cross-section of the nozzle array 101 and first electrode 102 of the apparatus for generating plasma according to the embodiment of the present disclosure along A direction.

Referring to FIGS. 2*a* and 2*b*, the nozzle array 101 includes a plurality of nozzles. Furthermore, the first electrode 102 may be disposed to contact at least some of the plurality of nozzles. In the apparatus for generating plasma according to an embodiment of the present disclosure, at least a portion of each of the plurality of nozzles included in the nozzle array 101 may be made of a material having conductivity. When an entirety or at least a portion of each of the nozzles is made of a conductive material, even a nozzle that does not directly contact the first electrode 102 may receive a voltage from the first electrode 102.

For example, nozzle 101*a* and nozzle 101*b* may be disposed to contact the first electrode 102, while nozzle 101*c* is disposed not to contact the first electrode 102. Even though the nozzle 101*c* does not contact the first electrode 102, since the nozzle 101*c* is disposed to contact the nozzle 101*a* or nozzle 101*b* and the nozzles 101*a*, 101*b*, 101*c*, . . . are made of a material having conductivity, the nozzle 101*c* may receive a voltage from the first electrode 102 just as the nozzle 101*a* and nozzle 101*b*. Likewise, in the perspective of the first electrode 102, even if the first electrode 102 contacts some of the plurality of nozzles, since at least some of the nozzles are made of a material having conductivity, nozzles that do not directly contact the first electrode 102 (for example, nozzle 101*c*) may also receive a voltage.

As aforementioned, the nozzles of the nozzle array 101 may be disposed adjacent to one another to minimize empty space between them. When the empty space is formed between the nozzles, plasma is formed between the nozzles, and thus plasma may not be formed evenly. In the apparatus for generating plasma according to the present disclosure, a plurality of nozzles are formed in the shape of needles disposed adjacent to one another such that they minimize the empty space between them, thereby forming a large area plasma evenly and stably.

FIGS. 2*a* and 2*b* illustrate the nozzle array 101 composed of nozzles having an exterior in the shape of a circle and an interior in the shape of a circle. However, the nozzles forming the nozzle array may not necessarily have a circular cross-section, and thus when necessary, the nozzles may be configured to have a polygonal cross-section instead of a circular cross-section to reduce the empty space between the nozzles. Other embodiments of the cross-section of the nozzles will be explained hereinafter with reference to FIGS. 4*a* to 4*c*.

Figure 3A:
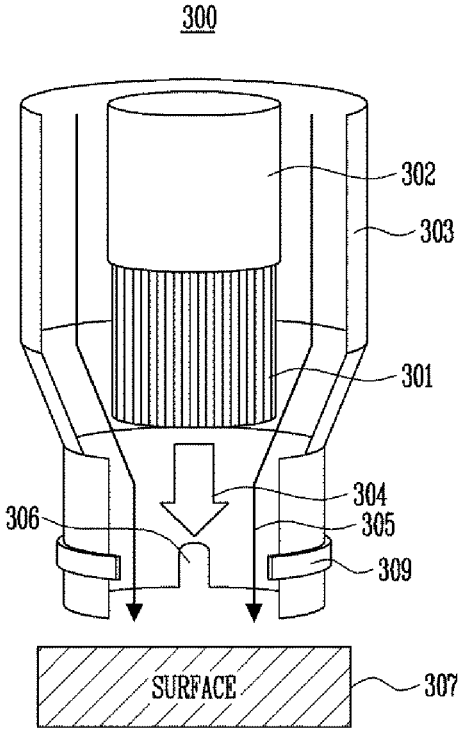
FIGS. 3*a* and 3*b* are views illustrating an apparatus for generating plasma according to another embodiment of the present disclosure.
Figure 3B:
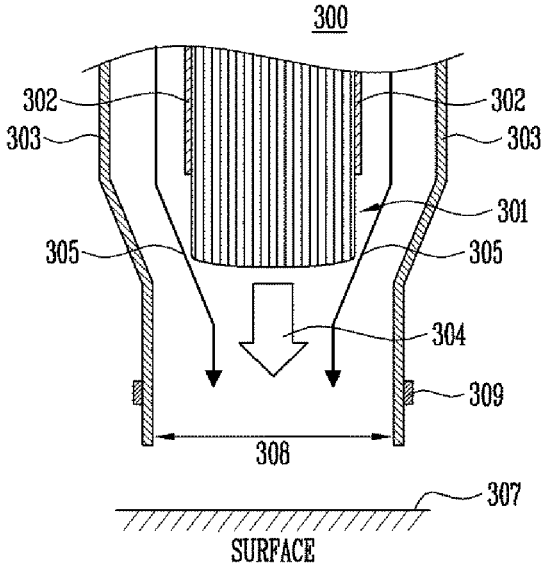

FIGS. 3*a* and 3*b* are views illustrating an apparatus for generating plasma according to another embodiment of the present disclosure.

Referring to FIGS. 3*a* and 3*b*, an apparatus for generating plasma according to another embodiment of the present disclosure 300 includes a nozzle array 301, first electrode 302 and housing 303. The nozzle array 301 discharges plasma 304. The first electrode 302 is disposed to surround the nozzle array 301. The housing 303 is disposed to surround the nozzle array 301 and first electrode 302. The nozzle array 301 includes a plurality of nozzles disposed adjacent to one another in the form of an array, each nozzle configured to discharge the plasma.

The housing 303 of the apparatus for generating plasma 300 may be disposed to surround the nozzle array 301 and first electrode 302. The housing 303 may include a plasma outlet 308 configured to discharge the plasma 304 generated in the nozzle array 301. The housing 303 may be disposed with a certain distance from the nozzle array 301 and first electrode 302, and form a protection gas path. Protection gas 305 may be generated from a protection gas generator (not illustrated) and be guided to flow through the protection gas path.

The housing 303 may include a side outlet 306 configured to discharge the plasma 305 already sprayed to a surface 307.

The apparatus for generating plasma 300 illustrated in FIGS. 3*a* and 3*b* is similar to the apparatus for generating plasma 100 illustrated in FIGS. 1*a* and 2*b*. However, the apparatus for generating plasma illustrated 300 in FIGS. 3*a* and 3*b* is different from the apparatus for generating plasma 100 illustrated in FIGS. 1*a* and 1*b* in that it further includes a second electrode 309. The apparatus for generating plasma 300 according to the another embodiment further includes the second electrode 309 formed in the shape of a ring on the housing 303. The second electrode 309 may be positioned near the plasma outlet 308 of the housing 303. The second electrode 309 may perform a function of reducing a breakdown voltage for generating plasma. As the second electrode 309 is additionally disposed, a uniform magnetic field is formed between the first electrode 302 and second electrode 309, allowing the plasma 304 to be sprayed evenly. According to embodiments, the second electrode 309 may be grounded or floated.

Otherwise, in an embodiment, a voltage may be applied to the second electrode 309 while the first electrode 302 is grounded or floated. That is, plasma may be generated with the polarity of the first electrode 302 and second electrode 309 changed.

Figure 4A:
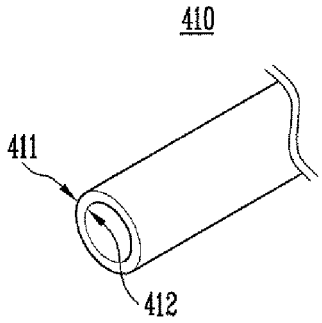
FIGS. 4*a* to 4*c* are exemplary views of different shapes of a nozzle included in a nozzle array of an apparatus for generating plasma according to an embodiment of the present disclosure.
Figure 4B:
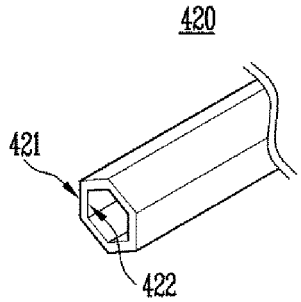
Figure 4C:
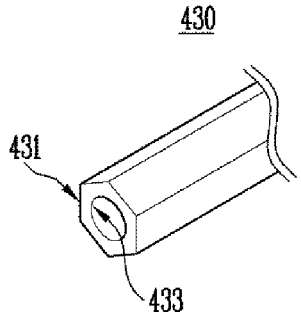

FIGS. 4*a* to 4*c* are exemplary views of different forms of a nozzle included in a nozzle array of an apparatus for generating plasma according to an embodiment of the present disclosure.

As illustrated in FIGS. 4*a* to 4*c*, the plurality of nozzles disposed in the nozzle array of the apparatus for generating plasma may have various shapes. In FIG. 4*a*, a nozzle 410 may have an exterior 411 in the shape of a circle and an interior 412 in the shape of a circle. The nozzle array composed of the nozzle 410 of FIG. 4*a* is illustrated in FIGS. 2*a* and 2*b*.

In some embodiments, the exterior of the nozzles may be configured to have a polygonal cross-section instead of a circular cross-section to further reduce the empty space between the nozzles. Furthermore, the exterior and interior of the nozzles may not necessarily have the same shape, that is, the nozzles may be configured to have a polygonal exterior and a circular interior. FIGS. 4*b* and 4*c* illustrate a nozzle having an exterior in the shape of a hexagon. The nozzle 420 illustrated in FIG. 4*b* has an exterior 421 and interior 422 in the shape of a hexagon, whereas the nozzle 430 illustrated in FIG. 4*c* has an exterior 431 in the shape of a hexagon and an interior 433 in the shape of a circle. As illustrated in FIGS. 4*b* and 4*c*, in the case of forming a nozzle array with nozzles having a hexagonal exterior, it is possible to minimize the empty space between the nozzles.

FIGS. 4*b* and 4*c* illustrate only cases where the exterior or interior of a nozzle is hexagonal, but when necessary, the nozzles may be configured to have an exterior and interior of various polygonal shapes.

Figure 5:
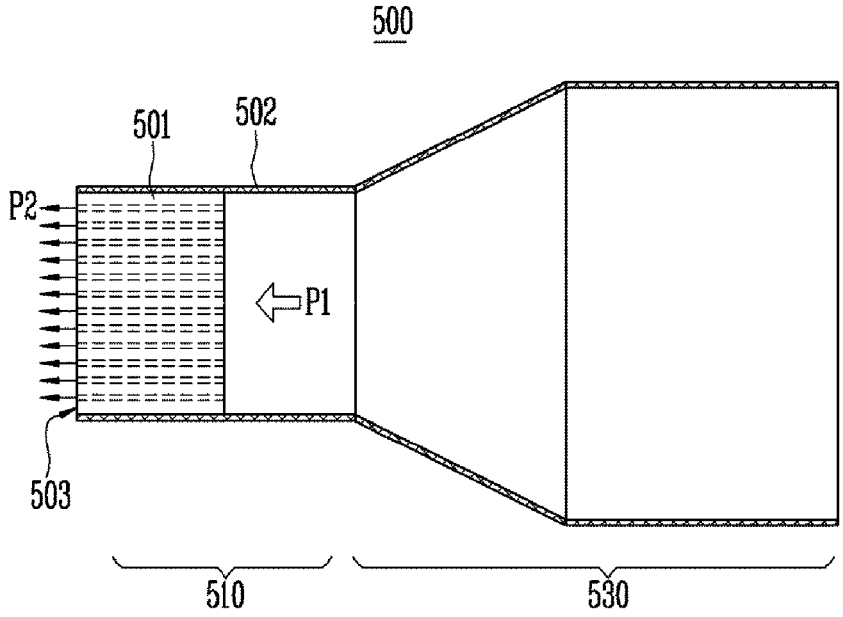
FIG. 5 is a schematic view of an apparatus for generating plasma according to another embodiment of the present disclosure.

FIG. 5 is a schematic view of an apparatus for generating plasma according to an embodiment of the present disclosure. Furthermore, FIG. 6 is a view of a plasma outlet of the apparatus for generating plasma of FIG. 5 in a plasma discharging direction.

Figure 6:
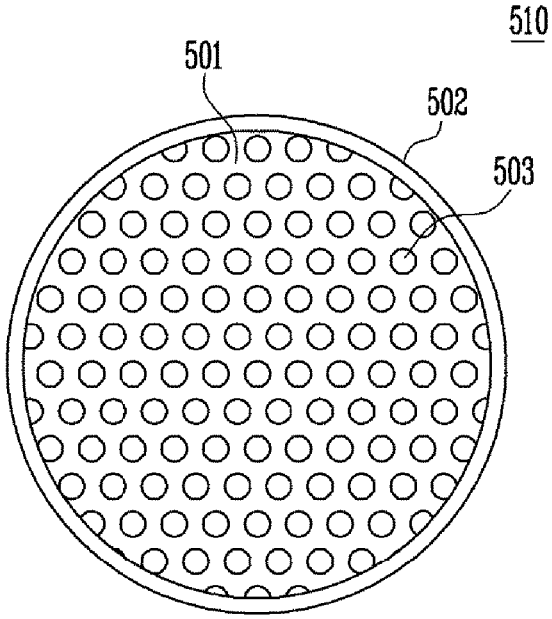
FIG. 6 is a view of a plasma outlet of the apparatus for generating plasma of FIG. 5 in a plasma discharging direction.

Referring to FIG. 5 and FIG. 6, an apparatus for generating plasma according to an embodiment of the present disclosure 500 includes a plasma generating unit 530 for generating plasma (P1) and a plasma outlet 510 for discharging the generated plasma (P1). The plasma outlet 510 disperses the plasma (P1) generated by the plasma generating unit 530 in a plurality of flows (P2).

The plasma outlet 510 may include a plasma moving unit 502 through which the plasma (P1) generated by the plasma generating unit 530 moves; and a plasma nozzle 501 disposed inside the plasma moving unit 502, includes a plurality of spray nozzles, and disperses the plasma (P1) generated by the plasma generating unit 510 in a plurality of plasma flows (P2). The plurality of spray nozzles 503 formed inside the plasma nozzle 501 play a role of allowing the generated plasma to be evenly sprayed over a subject area. According to an embodiment of the present disclosure, the spray nozzles 503 of the plasma nozzle 501 may be arranged in an even array format.

In a conventional apparatus for generating plasma, when plasma is being sprayed to a fluid that includes liquid or gas, the plasma will be sprayed through a single outlet, and thus there occurs a problem of the plasma being concentrated on one portion of the fluid. For example, when a single plasma is introduced into a fluid that is liquid, the plasma is introduced not evenly but is concentrated on one portion, thereby not being able to form a small bubble. That is, since the plasma will be sprayed in a big bubble form, a surface area where the plasma bubble touches the fluid will be smaller than the size of the bubble, thereby not being able to improve the effects of the plasma since, which is a disadvantage.

In order to overcome this disadvantage, the apparatus for generating plasma according to the embodiment of the present disclosure 500 is configured to include a plurality of spray nozzles 502 inside the plasma nozzle 501, and thus there is an advantage that the plasma (P2) sprayed from the plasma nozzle 501 may be evenly sprayed to a subject, more particularly, to a fluid. When a micro bubble is formed, the structure may be maintained for a long time without being changed compared to when a bubble is formed having a relatively big size. Furthermore, the smaller the bubble, the longer the time the bubble structure is maintained, and for the bubble where plasma is formed to contact the fluid and exert its effects for a long time, the smaller the size of the bubble formed by the plasma, the longer the time and bigger the surface area of the plasma bubble contacting the fluid, which is an advantage.

Therefore, in order to achieve the aforementioned purpose, there is provided a spray nozzle configured to form a small bubble such that it may evenly spray the plasma being introduced from the generating unit and maintain its size for a long time when the plasma contacts the fluid, especially, a liquid fluid.

That is, as illustrated in FIG. 5, when the plasma (P2) is discharged through the spray nozzle 502 having a plurality of holes and arranged in an array format, the plasma may be sprayed in a plurality of relatively small plasma flows. Accordingly, when the plasma is introduced into the fluid, there is obtained a high fluid reforming effect where the plurality of small plasma (P2) are directly emitted to the fluid over a large surface area.

Furthermore, since the spray nozzles are small, when the fluid is a liquid fluid, the plasma will be emitted in small bubbles, thereby forming small plasma bubbles. This is not only effective in that the small bubbles are changed by the plasma, but also the fluid may be reformed by the small bubbles.

Figure 7:
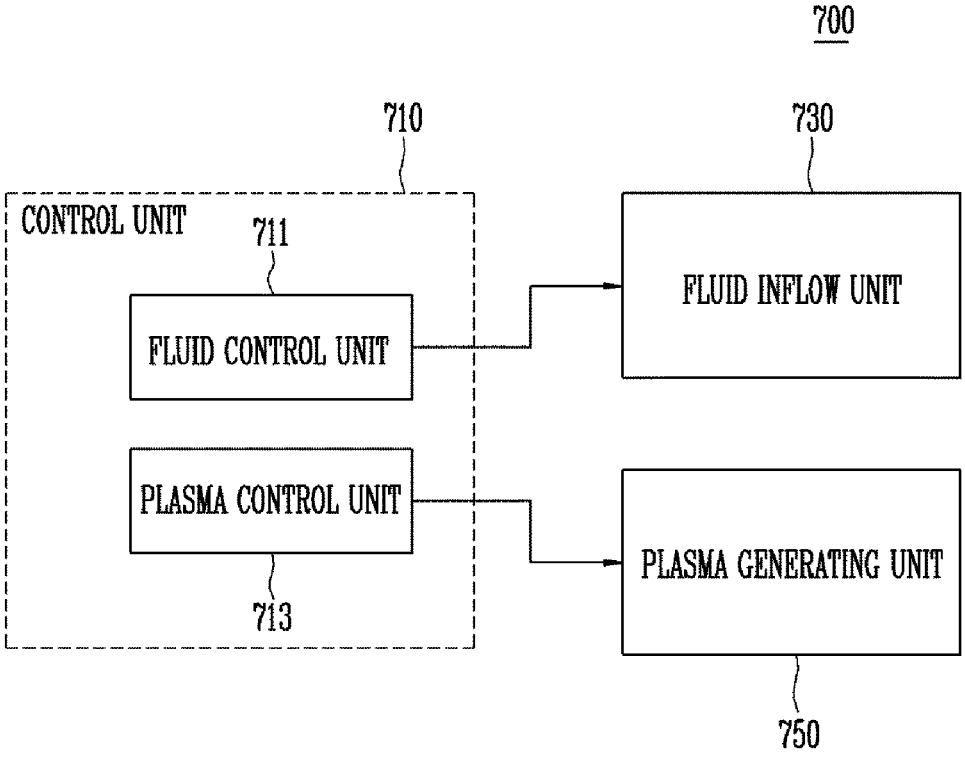
FIG. 7 is a block diagram illustrating an apparatus for generating plasma according to another embodiment of the present disclosure.

FIG. 7 is a block diagram illustrating an apparatus for generating plasma according to another embodiment of the present disclosure.

Referring to FIG. 7, an apparatus for generating plasma according to another embodiment of the present disclosure 700 may include a control unit 710, fluid inflow unit 730, and plasma generating unit 750. The control unit 710 may include a fluid control unit 711 and plasma control unit 713.

The fluid inflow unit 730 generates fluid and discharges the generated fluid outside the apparatus for generating plasma 700, and the plasma generating unit 750 generates plasma to reform the fluid being discharged outside. The fluid control unit 711 controls the fluid inflow unit 730 to control the flow of the fluid being discharged outside, and the plasma control unit 713 controls the plasma generating unit 750 to control generation of plasma being generated to reform the fluid. For example, when the plasma has only the purpose to reform the fluid being generated by the fluid inflow unit 730, the plasma control unit 713 may control the plasma generating unit 750 to generate plasma only when the fluid inflow unit 730 generates fluid.

In the apparatus for generating plasma according to the embodiment of the present disclosure 700, in the process where the fluid generated from the fluid inflow unit 730 is being discharged outside, the plasma generated in the plasma generating unit 750 reforms the fluid. The plasma generated in the plasma generating unit 750 is sprayed by the plasma curtain configured according to an embodiment of the present disclosure, and the plasma curtain includes a plurality of plasma spray nozzles formed to have a direction that is vertical, horizontal, or in a certain angle with respect to a moving direction of the fluid in a plasma moving path formed in the shape of a lattice as illustrated in FIGS. 8 to 13, and thus the plasma being sprayed from the plurality of plasma spray nozzles may evenly reform the flowing fluid.

Figure 8:
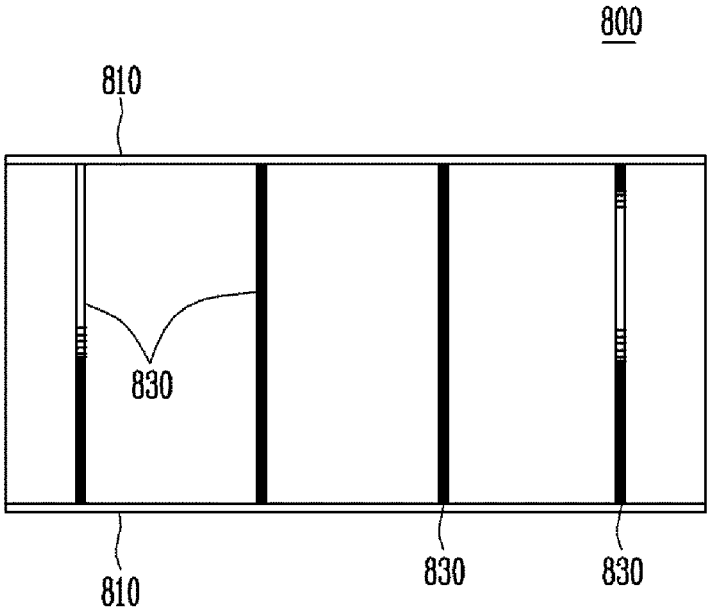
FIG. 8 is a cross-sectional view of a fluid moving path and plasma curtain of an apparatus for generating plasma according to an embodiment of the present disclosure.
Figure 9:
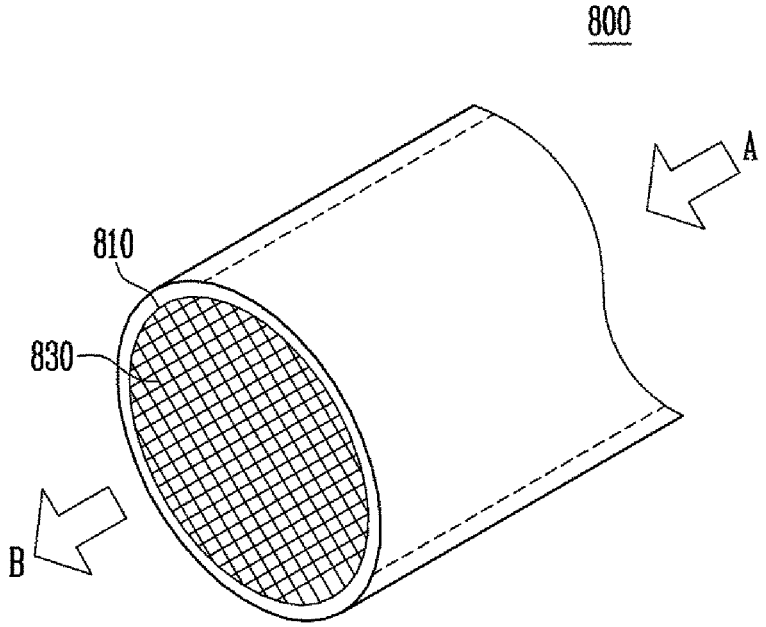
FIG. 9 is a perspective view of a fluid moving path and plasma curtain of an apparatus for generating plasma according to another embodiment of the present disclosure.

FIG. 8 is a cross-sectional view of a fluid moving path and plasma curtain of an apparatus for generating plasma according to an embodiment of the present disclosure. FIG. 9 is a perspective view of a fluid moving path and plasma curtain of an apparatus for generating plasma according to another embodiment of the present disclosure.

Referring to FIGS. 8 and 9, the apparatus for generating plasma 800 includes a fluid moving path 810 and plasma curtain 830. The control unit 710, fluid inflow unit 730, and plasma generating unit 750 are omitted from FIGS. 8 and 9. The fluid generated by the fluid inflow unit 730 is introduced into the fluid moving path 810 as illustrated in FIG. 9. The fluid moving path 810 is disposed at an end of a moving path of fluid (A), and the fluid (A) introduced by the fluid moving path 810 is reformed as it passes the plasma curtain 830, and is then discharged outside the apparatus for generating plasma 800. The fluid (B) being discharged is fluid reformed by the plasma curtain 830, that is, in the apparatus for generating plasma according to an embodiment of the present disclosure 800, the plasma being sprayed is reformed by at least one plasma curtain 830 disposed inside the fluid moving path 810. FIG. 8 is a mimetic diagram of a cross-section of a fluid moving path 810 and plasma curtain 830, and FIG. 9 is a mimetic diagram of a perspective view of the fluid moving path 810 and plasma curtain 830.

In FIG. 9, it is illustrated that there is one plasma curtain 830 installed inside the fluid moving path 810, but when necessary, a plurality of plasma curtains 830 may be formed inside the fluid moving path 810 as illustrated in FIG. 8. When a velocity of flow of fluid (A) is fast, it is possible to form a plurality of plasma curtains 830 that spray plasma, thereby improving the reforming quality of the fluid. Furthermore, when the singular plasma curtain 830 has insufficient reforming quality, it is possible to form a plurality of plasma curtains 830 such that they superimpose one another, thereby improving the reforming quality.

Although not illustrated in FIGS. 8 and 9, a power source path and plasma gas supply path for spraying the plasma from the plasma curtain 830 may be formed outside or inside the fluid moving path 810. In an embodiment, the fluid moving path 810 itself may be configured to play a role as the power source path and plasma gas supply path. By the power source path and plasma gas supply path, the generated plasma may be sprayed in a direction vertical, horizontal or in a certain angle with respect to a moving direction of the fluid (A) from the plasma curtain (A).

Figure 10:
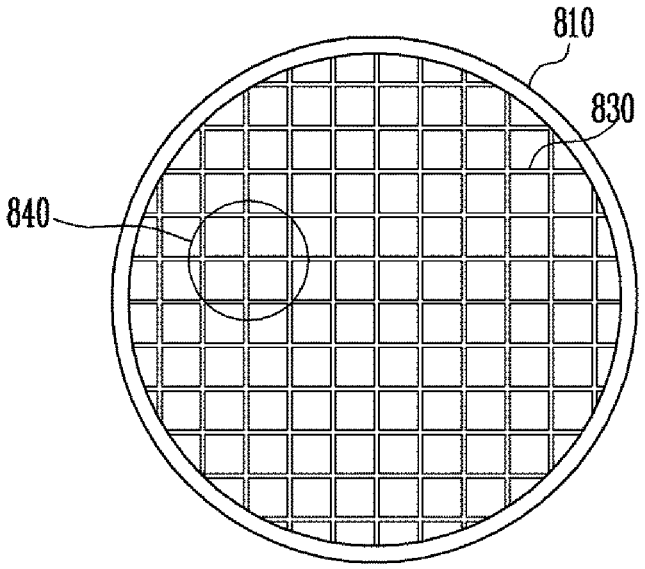
FIG. 10 is a front view of a fluid moving path and plasma curtain of an apparatus for generating plasma according to an embodiment of the present disclosure.

FIG. 10 is a front view of a fluid moving path and plasma curtain of an apparatus for generating plasma according to an embodiment of the present disclosure.

In FIG. 10, the fluid moving path 810 and plasma curtain 830 of the apparatus for generating plasma are illustrated. It is to be noted that FIG. 6 is a front view of the fluid moving path 810 and plasma curtain 830 seen from the front.

As illustrated in FIG. 10, the plasma curtain 830 is formed to have the shape of a lattice. When the fluid arrives at the plasma curtain 830 after it moves through the fluid moving path 810, the fluid passes a square shaped empty space of the plasma curtain 830 of a lattice shape. While the fluid passes through the empty space of the plasma curtain 830, the plasma curtain 830 sprays the plasma to the fluid and reforms the fluid. According to the apparatus for generating plasma according to an embodiment of the present disclosure, the plasma curtain 830 is formed to have a lattice shape and sprays the plasma evenly to an entirety of area in a vertical, horizontal or in a certain angle with respect to the flow of fluid, thereby improving the reforming quality of the fluid. The structure and plasma spraying of the plasma curtain 830 will be explained in further detail hereinafter with reference to FIGS. 11*a* and 11*b*. An area 840 of the plasma curtain 830 shown in a circle in FIG. 10 is enlarged and shown in FIGS. 11*a* and 11*b*.

Figure 11A:
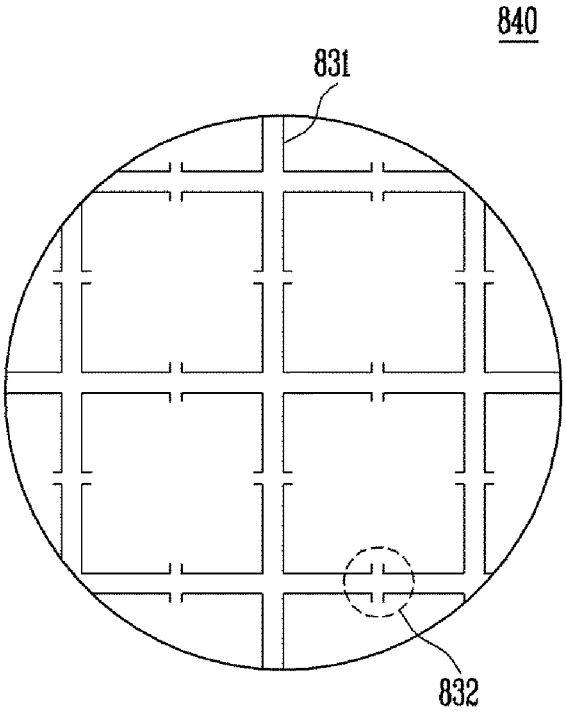
FIGS. 11*a* and 11*b* are views illustrating in detail a plasma curtain of an apparatus for generating plasma according to an embodiment of the present disclosure.
Figure 11B:
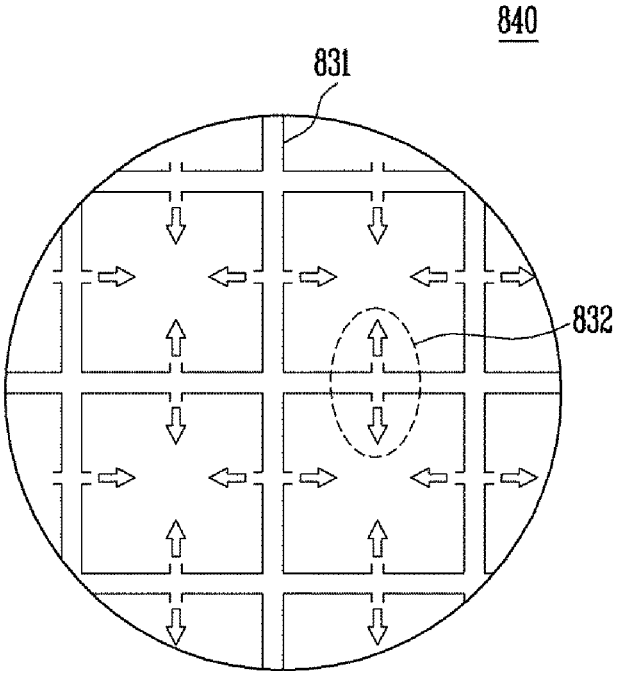

FIGS. 11*a* and 11*b* are views illustrating in detail the plasma curtain of the apparatus for generating plasma according to an embodiment of the present disclosure. In FIGS. 11*a* and 11*b*, the one area 840 of the plasma curtain 830 illustrated in FIG. 10 is enlarged. The plasma curtain 830 includes a plasma moving path 831 formed to have the shape of a lattice and a plurality of plasma spray nozzles 832 formed in a vertical direction to the moving direction of the fluid.

Referring to FIG. 11*a*, the plasma moving path 831 included in the plasma curtain 830 may be formed as a pipe having the shape of a lattice. Furthermore, the plasma spray nozzle 832 may be formed in a direction vertical to the flow of the fluid on the plasma moving path 831. In FIG. 11*a*, it can be seen that the plurality of plasma spray nozzles 832 are formed in two directions that are vertical to each other. As explained above with reference to FIGS. 8 and 9, the fluid (A) is induced through the fluid moving path 810 and passes the plasma curtain 830, and thus it can be seen that the plasma spray nozzles 832 of FIG. 11*a* are formed in a direction vertical to the proceeding direction of the fluid. In FIG. 11*a*, it is illustrated that the plurality spray nozzles 832 are formed in a direction vertical to the proceeding direction of the fluid, but when necessary, the plasma spray nozzles may be formed in a vertical or in a certain angle with respect to the proceeding direction of the fluid.

Referring to FIGS. 11*a* and 11*b*, the plasma that moved through the plasma moving path 831 is sprayed through the plasma spray nozzle 832. FIG. 11 a illustrates a situation before the plasma is actually sprayed, and FIG. 11*b* illustrates a situation where the plasma generated is sprayed through the plasma spray nozzle 832 by the plasma control unit. In FIG. 11*b*, it is to be noted that the plasma being sprayed through the plasma spray nozzle 832 is illustrated mimetically by an arrow. The plasma is sprayed in a vertical direction to the moving direction of the fluid. As aforementioned, the plasma spray nozzles may be formed in a horizontal or in a certain angle with respect to the proceeding direction of the fluid, in which case the plasma may also be sprayed in a horizontal or in a certain angle with respect to the proceeding direction of the fluid. Referring to FIG. 10, FIG. 11*a* and FIG. 11*b*, the plasma curtain 830 sprays the plasma in a direction vertical to the moving direction of the fluid, and sprays the plasma through the plasma spray nozzle 832 distributed over an entirety of area of a cross section of the fluid moving pat, and thus it is possible to evenly reform the entirety of the flowing fluid. That is, the plasma curtain 830 included in the apparatus for generating plasma according to an embodiment of the present disclosure includes a plurality of plasma spray nozzles, and thus is capable of maximizing the area where the fluid meets the plasma so that most of the fluid that passes the plasma curtain 830 contacts the plasma, thereby improving the reforming quality of the constituents of the fluid.

In FIGS. 11*a* and 11*b*, the plasma spray nozzles 832 are illustrated to have a duct shape protruding from the plasma moving path 831, but in other embodiments, they may play a role of holes or plasma spray nozzles formed to have a certain distance from one another.

Figure 12:
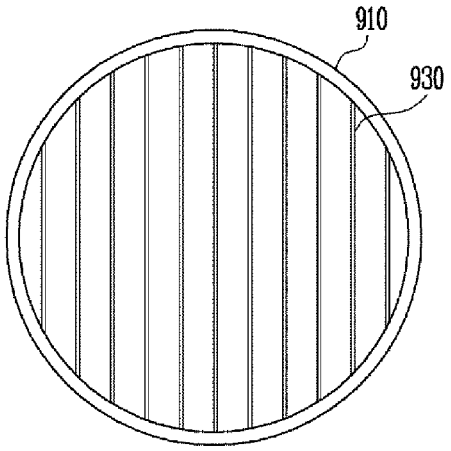
FIG. 12 is a front view of a fluid moving path and plasma curtain of an apparatus for generating plasma according to another embodiment of the present disclosure.

FIG. 12 is a front view of a fluid moving path and plasma curtain of an apparatus for generating plasma according to another embodiment of the present disclosure.

Referring to FIG. 12, a plasma curtain 930 is illustrated to have a different shape than that illustrated in FIG. 10. The plasma curtain 830 illustrated in FIG. 10 is formed to include a plasma moving path having a lattice shape, and thus fluid passes a square shaped empty space, but the plasma curtain 930 illustrated in FIG. 12 includes a plasma moving path having a comb-pattern or stripes where a plurality of long pipes are arranged parallel to one another. Therefore, it can be seen that the plasma spray nozzles of the plasma curtain 830 illustrated in FIG. 10 are formed in four directions, that is up, down, left, and right directions on the lattice shaped plasma moving path, but the plasma spray nozzles of the plasma curtain 930 illustrated in FIG. 12 are formed in two directions of left and right directions on the moving path arranged in stripes parallel to one another.

The plasma curtain 930 according to the embodiment of FIG. 12 may have less ability to evenly spray plasma than the plasma curtain 930 according to the embodiment of FIG. 10, but the plasma curtain 930 structure of FIG. 12 is more simple than the structure of the plasma curtain 830 of FIG. 10, and thus incurs less manufacturing costs than the plasma curtain 830 of FIG. 10.

Figure 13:
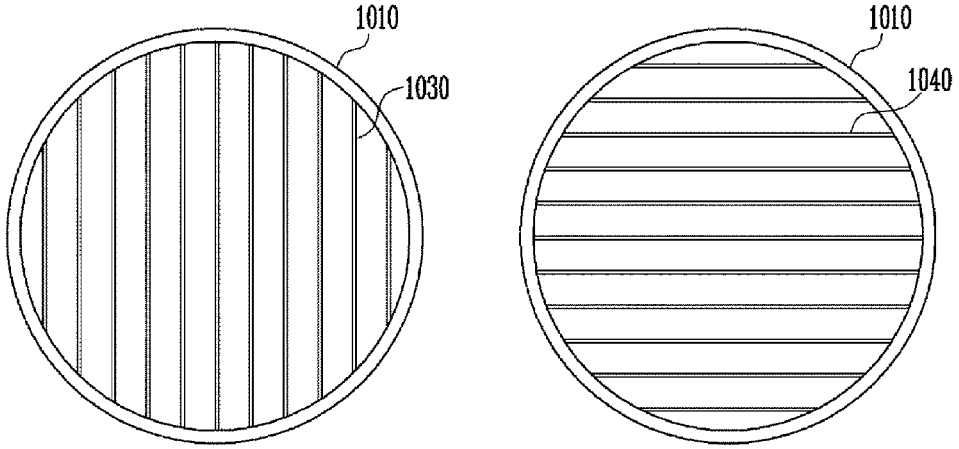
FIG. 13 is a view illustrating a plurality of plasma curtains.

FIG. 13 is a view illustrating a plurality of plasma curtains.

As illustrated in FIG. 13, it is possible to change the direction of the plasma curtain of FIG. 12 and install a plurality of them thereby improving the quality of reforming the fluid. Especially, referring to FIG. 8, an apparatus for generating plasma according to an embodiment of the present disclosure may be configured to include a plurality of plasma curtains 830 inside the fluid moving path 810, and thus by disposing two plasma curtains 1030, 1040 inside the fluid moving path 1010 such that they superimpose each other and such that the directions of the plasma moving paths are vertical to each other, it is possible to improve the quality of reforming the fluid that passes the plasma curtains 1030, 1040 successively.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. An apparatus for generating plasma, the apparatus comprising:

a nozzle array configured to discharge plasma;

a first electrode disposed to surround the nozzle array; and a housing disposed to surround the nozzle array and the first electrode, wherein the nozzle array includes a plurality of nozzles disposed adjacent to one another in the form of an array, each nozzle configured to discharge plasma in a first direction, and wherein a cross-section, perpendicular to the first direction, of an exterior surface of each of the plurality of nozzles is polygonal.

2. The apparatus according to claim 1, wherein each of the plurality of nozzles includes a conductive material.

3. The apparatus according to claim 2, wherein the each of the plurality of nozzles is disposed to contact its adjacent nozzles through the portion made of the conductive material.

4. The apparatus according to claim 1, wherein the housing comprises a plasma outlet through which the plasma discharged from the nozzle array is sprayed.

5. The apparatus according to claim 4, wherein the housing is disposed with a certain distance from the nozzle array and first electrode, and forms a protection gas path.

6. The apparatus according to claim 1, wherein the housing comprises a side outlet configured to discharge the plasma already sprayed to a surface.

7. The apparatus according to claim 1, wherein the first electrode contacts at least a portion of the plurality of nozzles of the nozzle array.

8. The apparatus according to claim 1, further comprising a second electrode configured to have a shape of a ring on the housing.

9. The apparatus according to claim 8, wherein the second electrode is grounded.

10. The apparatus according to claim 8, wherein the second electrode generates a high voltage, and the first electrode is grounded or floated.

11. The apparatus according to claim 1, wherein a cross-section, perpendicular to the first direction, of an interior surface of each of the plurality of nozzles is polygonal.

12. The apparatus according to claim 1, wherein a cross-section, perpendicular to the first direction, of an interior surface of each of the plurality of nozzles is circular.

13. The apparatus according to claim 1, wherein each of the plurality of nozzles is conductive.

14. An apparatus for generating plasma, the apparatus comprising:

a plasma generating unit configured to generate plasma, the plasma generating unit including a nozzle array configured to discharge the generated plasma, and a first electrode disposed to surround the nozzle array; and a plasma outlet configured to outlet the generated plasma, wherein the plasma outlet disperses the plasma generated by the plasma generating unit in a plurality of plasma flows, wherein the nozzle array includes a plurality of nozzles disposed adjacent to one another in the form of an array, each nozzle configured to discharge the generated plasma in a first direction, and wherein a cross-section, perpendicular to the first direction, of an exterior surface of each of the plurality of nozzles is polygonal.

15. The apparatus according to claim 14, wherein the plasma outlet comprises a plasma moving unit through which the plasma generated by the plasma generating unit moves; and a plasma nozzle disposed inside the plasma moving unit, includes a plurality of spray nozzles, and disperses the plasma generated by the plasma generating unit in the plurality of plasma flows.

16. The apparatus according to claim 15, wherein the plasma moving unit has a shape of a pipe, and the plurality of spray nozzles formed in the plasma nozzle are arranged evenly in an array format.

17. An apparatus for generating plasma, the apparatus comprising:

a fluid inflow unit configured to generate fluid;

a fluid moving path configured to move the generated fluid; and at least one plasma curtain disposed inside or outside the fluid moving path, and configured to spray the plasma to the fluid, wherein the at least one plasma curtain comprises a first plasma curtain and second plasma curtain, the first plasma curtain including a plurality of first plasma moving paths arranged parallel to one another in a first direction, the second plasma curtain including a plurality of second plasma moving paths arranged parallel to one another in a second direction that is vertical to the first direction, and the first direction and second direction both in a vertical, horizontal, or a certain angle with respect to a moving direction of the fluid, wherein, the first plasma curtain further includes, on the first plasma moving paths arranged parallel to one another, a plurality of first plasma spray nozzles that are each formed in a direction vertical to the moving direction of the fluid, and the second plasma curtain further includes, on the second plasma moving paths arranged parallel to one another, a plurality of second plasma spray nozzles that are each formed in a vertical, horizontal, or certain angle with respect to the moving direction of the fluid, and wherein the plasma curtain is configured such that the fluid passes between the second plasma moving paths after passing between the first plasma moving paths successively.

18. The apparatus according to claim 17, wherein each of the first and second plasma moving paths are formed to have a lattice shape.

* * * * *